United States Patent [19]

Kelsall

[11] Patent Number: 4,733,339

[45] Date of Patent: Mar. 22, 1988

[54] MOUNTING SYSTEM FOR RECESSED LIGHT FIXTURE

[75] Inventor: Jeffrey C. Kelsall, Roselle, Ill.

[73] Assignee: Cooper Industries, Houston, Tex.

[21] Appl. No.: 898,479

[22] Filed: Aug. 21, 1986

[51] Int. Cl.[4] ..... F21S 1/06; F21S 3/06

[52] U.S. Cl. ..... 362/366; 362/365

[58] Field of Search ..... 362/364, 365, 366, 368, 362/374, 148

[56] References Cited

U.S. PATENT DOCUMENTS

| | | | |
|---|---|---|---|
| 2,587,423 | 2/1952 | Young | 362/364 X |
| 3,070,691 | 12/1962 | Relich | 362/364 |
| 3,096,024 | 7/1963 | Young | 362/364 X |
| 3,276,014 | 9/1966 | Rueger | 362/365 X |
| 3,316,399 | 4/1967 | Totten | 362/364 X |
| 3,518,420 | 6/1970 | Kripp | 362/364 X |
| 3,659,093 | 4/1972 | Rieth | 362/366 |
| 3,708,850 | 1/1973 | Martin | 362/365 X |
| 4,293,895 | 10/1981 | Kristofek | 362/364 X |
| 4,388,677 | 6/1983 | Druffel | 362/364 X |
| 4,450,512 | 5/1984 | Kristofek | 362/294 X |
| 4,623,956 | 11/1986 | Conti | 362/364 X |
| 4,636,924 | 1/1987 | Targetti | 362/364 X |

FOREIGN PATENT DOCUMENTS

| | | | |
|---|---|---|---|
| 811148 | 4/1959 | United Kingdom | 362/364 |

*Primary Examiner*—Albert W. Davis, Jr.
*Assistant Examiner*—Richard R. Cole
*Attorney, Agent, or Firm*—E. E. Scott; A. R. Thiele

[57] ABSTRACT

A clip for retaining a light canister in a ceiling includes a bendable leg member which is positionable between a first position and a second position. In the first position, the canister is insertable into a hole in a ceiling and in the second position, the bendable leg member is moved away from the canister so as to retain the canister within the ceiling. A brace member extends between the bendable leg member and the canister to retain the bendable leg member in its second position.

13 Claims, 6 Drawing Figures

Fig. 3
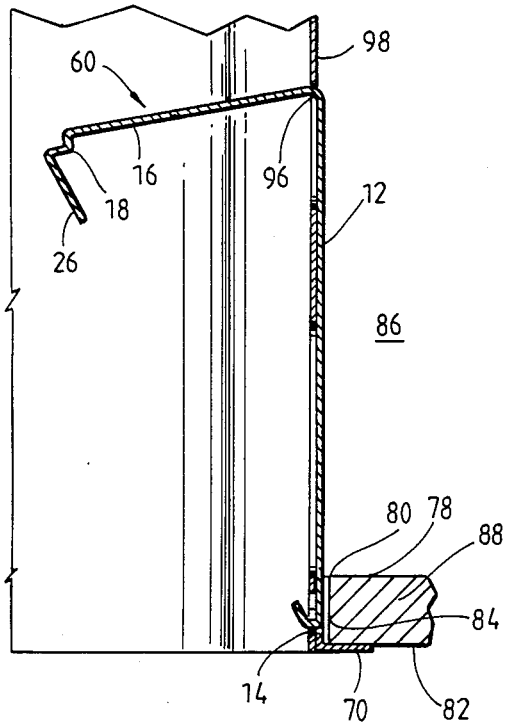
Fig. 4
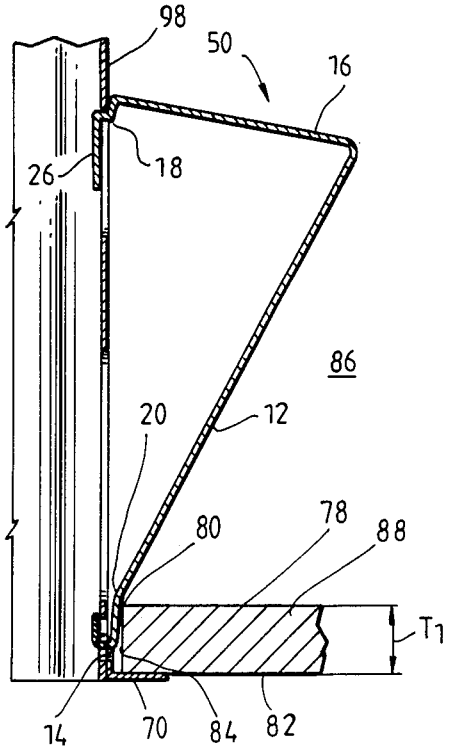
Fig. 5
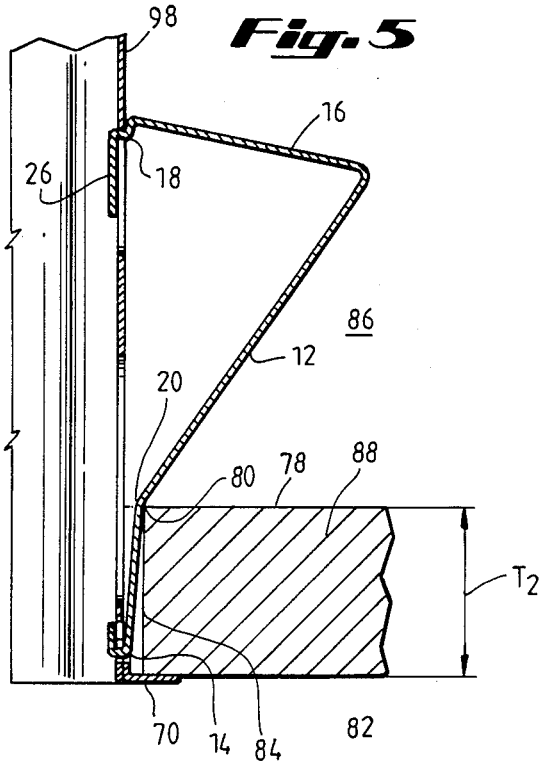
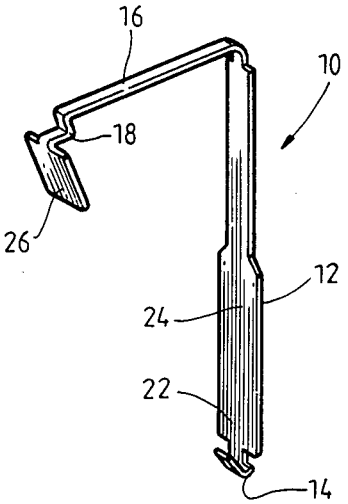
Fig. 6

MOUNTING SYSTEM FOR RECESSED LIGHT FIXTURE

BACKGROUND OF THE INVENTION

This invention refers generally to a method of mounting recessed lighting fixtures, more particularly the present invention relates to spring clips which are used for holding recessed lighting fixtures in an opening in a ceiling.

Recessed lighting fixtures are often used in situations where a room is being remodeled. This remodeling oftentimes involves the inclusion of a false or drop ceiling in which the recessed lighting fixtures are mounted. In other cases, recessed lighting fixtures are mounted in holes made in existing ceilings. Specifically, the bottom of the lighting fixture is mounted flush with the visible surface of the ceiling and the body of the lighting fixture projects into the space above the ceiling. The retention of recessed lighting fixtures within and above a ceiling presents a particular problem for installers as it is often difficult to gain access to the topside or unseen portion of the ceiling. Therefore, the need exists to provide a method for quickly and easily mounting recessed lighting fixtures in ceilings without the necessity to gain access to the unseen portion of the ceiling. Such fixtures must also be easily removable for inspection, cleaning or repair.

Attempts have been made to use various mechanical means to engage the ceiling for mounting recessed lighting fixtures. Such mechanical means may include flanges which sandwich the ceiling itself to provide structural support for the lighting fixture. Such fixtures are inherently limited in their operation if the space between the sandwiching flanges is fixed. Specifically, the sandwiching of the ceiling requires additional installation manipulations. A workman installing such a light fixture must first push the light fixture into the hole in the ceiling then sandwich the ceiling between two flanges. In some fixtures, the installer must also compress a spring clip with his free hand or with a special tool. The spring clip provides additional force to press against the topside of the ceiling. Such manipulations are difficult, at best, even for the most coordinated and skilled workmen. Typical of such a device is the one described in U.S. Pat. No. 3,620,401.

Other recessed lighting fixtures have adjustable means for mounting the fixture to the ceiling. Such fixtures are cumbersome in their operation and time consuming to install. Typical of such a device is the one described in U.S. Pat. No. 4,048,491.

Accordingly, the problem exists of providing a recessed lighting fixture that may be used with a wide variety of ceiling widths that may be easily installed and removed in a minimum of time.

SUMMARY OF THE INVENTION

A mounting system for a recessed lighting fixture usable with a wide variety of ceiling widths consists of a plurality of clips which are spaced around the periphery of the canister portion of the recessed lighting fixture. The clips used for retaining the recessed lighting fixture in a ceiling consist of a bendable leg member movable between two positions. This ability of the leg member to move is facilitated by a hole in the wall of the can-shaped canister portion of the lighting fixture.

The first position of the bendable leg member allows for the insertion or removal of the canister portion of the recessed lighting fixture into a hole in the ceiling. The second position of the bendable leg member retains the canister in the ceiling. The bendable leg member is moved between its first and second positions by pivoting one end of the clip against a portion of the canister. During the pivoting of the clip from the first position to the second position, the bendable leg member engages the corner formed between the top side of the ceiling and the side of the hole cut in the ceiling for mounting the fixture. This engagement of the bendable leg member with the corner between the hole and the topside of the ceiling causes an inward bend in the bendable leg member. It is the mechanical engagement of this inward bend in the clip and the ceiling which causes the recessed lighting fixture to be retained in the ceiling. The bendable leg member is retained in its second position by a brace member which extends from the outboard end of the bendable leg member back to an opening in the canister. The resilient nature of the brace member and mechanical engagement of the inboard end of the brace member with the canister portion of the lighting fixture retains the bendable leg member in its second position.

BRIEF DESCRIPTION OF THE DRAWINGS

A better understanding of the mounting system of the present invention may be had by reference to the drawings wherein:

FIG. 3 is a side view in partial section of the recessed lighting fixture just after insertion into a ceiling;

FIG. 4 is a side view in partial section of the recessed lighting fixture mounted in a relatively thin ceiling.

FIG. 5 is a side view partial section of the recessed lighting fixture mounted in a relatively thick ceiling; and FIG. 6 is a perspective view of the mounting clip.

DESCRIPTION OF THE EMBODIMENTS

Figure 1:
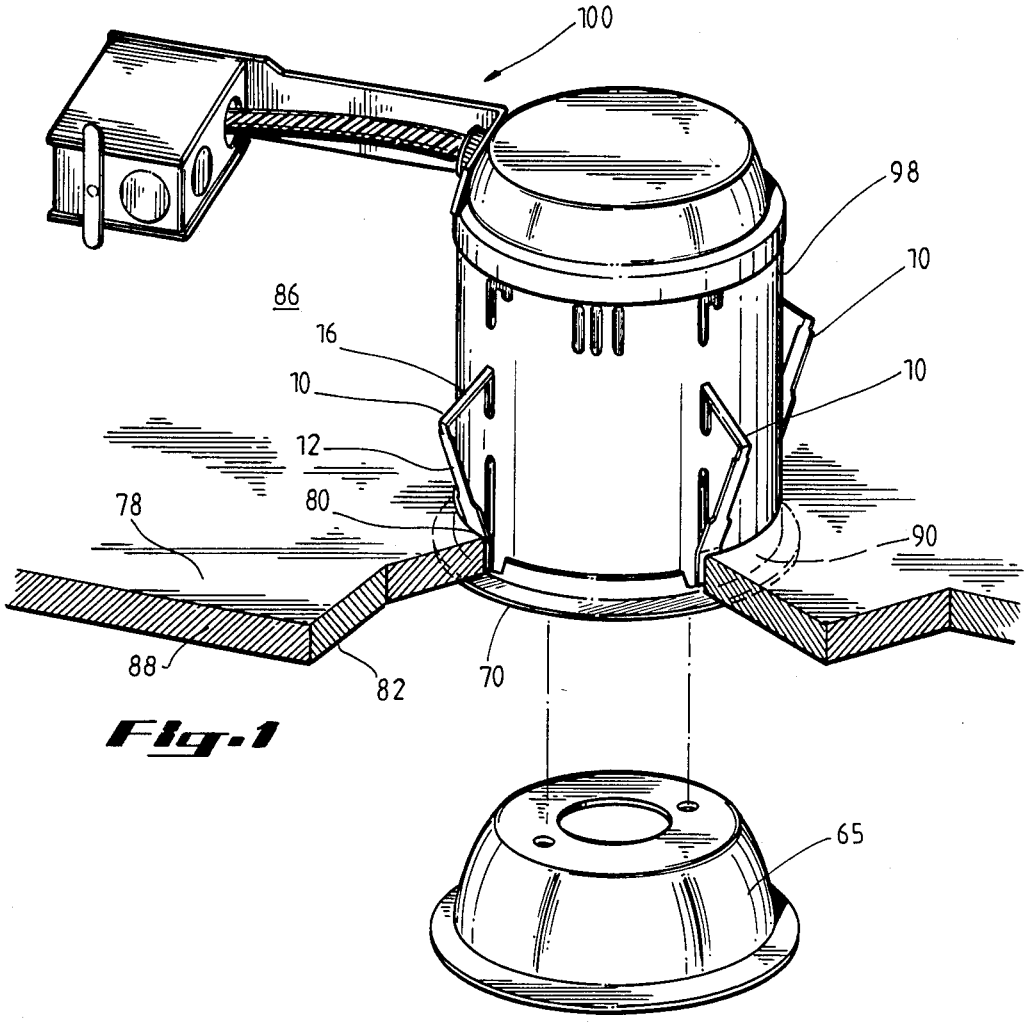
FIG. 1 is a perspective view of a recessed lighting fixture incorporating the mounting system of the present invention.
Figure 2:
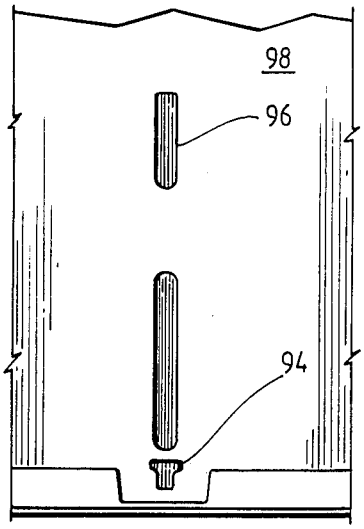
FIG. 2 is a side view of the recessed lighting fixture in FIG. 1 with the mounting clip removed.

Recessed lighting fixtures 100 as shown in FIGS. 1 and 2 are inserted into new or existing ceilings by placing canister portion 98 of light fixture 100 in a hole 90 in ceiling 88. Once mounted in ceiling 88, the body of the canister 98 occupies the space 86 above ceiling 88. A trim ring 65 is fitted into the bottom of canister 98 and is designed to mask edge 84 of hole 90 and provide a decorative appearance for lighting fixture 100 once mounted in ceiling 88.

To retain the lighting fixture 100 in ceiling 88, clips 10 are placed around the periphery of canister 100. Such arrangement of clips 10 is shown in FIG. 1. It is important that clips 10 be both easy to use and sufficiently strong to retain canister 98 in ceiling 88 as it is clips 10 alone which hold fixture assembly 100 in position. As installers of canisters 100 are forced to work over their head, mounting clips 10 must be easy to use and rapidly positionable irrespective of the thickness of the ceiling 88. The reduction in manipulative steps provided by the present invention saves time and reduces installer fatigue.

The construction of clip 10 used in the mounting system of the present invention is shown in FIG. 6. Bendable leg member 12 forms the operative portion of clip 10. On one end of bendable leg member 12 is bent portion 14 which serves as a pivot to allow bendable leg member 12 to be moved between its first 60 and second 50 positions (FIGS. 3 and 4). At the other end of bendable leg member 12 a brace member 16 is formed of sufficient length to extend between bendable leg member 12 and the side of canister portion 98 of fixture 100. A step or offset 18 is formed in brace member 16 to engage the side of canister 98 when bendable leg member 12 is moved away from the side of canister 98 as shown in FIG. 1. That portion of bendable leg member 12 which is bendable is thickened in the preferred embodiment. While such thickening is shown in the preferred embodiment it will be understood that clips 10 are operable without such thickening. As shown in FIG. 2, the attachment of clips 10 to canister 98 is facilitated by the use of holes 96 and 94. Brace member 16 passes through hole 96 while hole 94 is designed to accommodate the pivotal mounting of bent portion 14.

As shown in FIG. 3, mounting clips 10 of the present invention are designed so that bendable leg member 12 of clip 10 lies flush along the outside of canister 98 when canister 98 is either inserted into or removed from ceiling 88. This position 60, termed the first position, is characterized by bendable leg member 12 lying alongside of canister 98 and brace member 16 extending inwardly through opening 96 in the wall of canister 98. Once canister 98 has been fully inserted through hole 90 in ceiling 88 so that flange 70 at the bottom of canister 98 contacts underside 82 of ceiling 88 to mask the edge of hole 90, bendable leg member 12 is moved outwardly away from canister 98 to second position 50. This causes brace member 16 to be drawn out of canister 98 through hole 96. During this movement, bendable leg member 12 engages corner 80 formed between top side 78 of ceiling 88 and the edge 84 of hole 90. This engagement causes bendable leg member 12 to bend inwardly as shown in FIGS. 4 and 5. It is this inward bend which holds fixture 100 in position with respect to ceiling 88. Bend 20 formed at corner 80 of side 84 of hole 90 and top 78 of ceiling 88 can be made in ceilings having a wide variety of thicknesses.

Sizing bendable leg member 12 to engage ceilings of thicknesses from ¼" to 1½" allows utilization of the mounting system of the present invention with almost all commonly found interior construction. If the ceiling is thin, $T_1$, as shown in FIG. 4, lower portion 22 of the bendable leg member 12 engages ceiling 88. If the ceiling is thick, $T_2$, as shown in FIG. 5, midst 24 of bendable leg member 12 engages ceiling 88. It will be noted that as shown in FIG. 4, the mounting of canister 98 in ceiling 88, effected by the movement of clip members 10 from first position 60 to second position 50, will cause clip member 10 to bend along its bendable leg portion 12. As bendable leg member 12 is bendable at any point along its length, there are an infinite number of ceiling widths which may be accommodated by the recessed lighting fixture mounting system of the present invention. Such adaptability allows use of the mounting system of the present invention anywhere in the country and in offices or homes built from a wide variety of materials. Other prior art fixtures do not provide this adaptability in mounting systems for recessed lighting fixtures.

Retaining clip member 10 in second position 50 is the engagement of step or offset 18 of brace member 16 with the side of canister 98. Facilitating this engagement is the resiliency of brace member 16 with respect to bendable leg member 12. This resiliency causes brace member 16 to spring outwardly toward the top of canister 98 when clip member 10 is moved from its first position 60 to its second position 50. This outward springing of brace member 16 prevents clip 10 from moving back to first position 60. It will be understood that a variety of mechanical engagement means may be used in place of offset 18 without departing from the scope of the present invention.

Additionally, brace member 16 includes a stop member 26 at its inboard end in the preferred embodiment. Stop member 26 is an enlarged portion formed at the end of brace member 16. Sop member 26 prevents clip member 10 from moving out of engagement with canister 98. Specifically, when clip member 10 is moved from first position 60 to second position 50, stop member 26 will engage inside of canister 98 thereby preventing clip member 10 from falling away from the outside of canister 98.

When it is desired to remove fixture 100 from ceiling 88 the installation process is reversed. Specifically, stop member 26 is moved back into the midst of the canister 98 through hole 96. Stop member 26 is followed by brace member 16. Bendable leg member 12 is thereby moved out of engagement with ceiling 88 thus allowing fixture 100 to be removed from ceiling 88.

Clip members 10 may be preferably constructed of a resilient material such as spring or sheet steel, however, any other spring or sheet material such as a spring plastic or resilient aluminum may be used. Clip members 10 may be formed by a simple bending or molding operation.

From the foregoing description of the preferred embodiment, it can be seen that the present invention provides an improved system for mounting a recessed light fixture 100 quickly and easily in an opening 90 in a ceiling 88, irrespective of the thickness of the ceiling 88.

While there has been illustrated and described what is at present considered to be the preferred embodiment of the present clip mounting device 10, it will be understood by those skilled in the art to which this system pertains that various changes and modifications may be made to the preferred embodiment, and equivalents may be substituted for certain elements thereof without departing from the true scope and nature of the present invention. In addition, many modifications may be made to the disclosed clip device 10 to adapt to a particular situation or certain material the teachings of the present invention without departing from the central scope thereof. Therefore, it is intended that this invention not be limited to the particular embodiment disclosed as the best mode contemplated but that the invention include all embodiments falling within the scope of the appended claims.

I claim:

1. A mounting system for a recessed lighting fixture having side walls to be mounted in a hole in a ceiling mounted system comprising:

a bendable leg member, said bendable leg member movable between a first position along the side wall of the fixture and a second position away from the side wall of the fixture;

means for pivoting said bendable leg member between said first and second positions formed on one end of said bendable leg member;

means for retaining said bendable leg member in said second position;

whereby the recessed lighting fixture may be retained in the ceiling irrespective of ceiling thickness by first inserting the canister portion of the lighting fixture into the ceiling with said leg member in said first position and then pivoting said bendable leg member into engagement with the ceiling so that the engagement of said bendable leg member with the ceiling causes the bendable leg member to flex toward said recessed lighting fixture and engaging said means for retaining said bendable leg member with the side wall to retain said bendable leg member in said second position.

2. The mounting system as defined in claim 1 wherein said means for pivoting said bendable leg member is a mechanical engagement of said bendable leg member in a hole formed in the side wall of the recessed lighting fixture.

3. The mounting system as defined in claim 1 wherein said means for retaining said bendable leg member in said second position is a resilient brace member.

4. The mounting system as defined in claim 3 wherein said brace member includes an offset portion engagable with a hole formed in the side wall of the fixture.

5. The mounting system as defined in claim 3 wherein said brace member includes a stop member engagable with the inside of the side wall of the fixture.

6. A mounting system for retaining a recessed lighting fixture having a canister with a side portion to a ceiling, said system comprising:

a bendable leg member, said bendable leg member having a first position characterized by lying along the side portion of the canister to permit the insertion of the canister into a hole in the ceiling and a second position wherein the bendable leg member is positioned away from the side of the canister for retaining the recessed lighting fixture in the ceiling;

a pivotable engagement means formed on one end of said bendable leg member for pivoting said bendable leg member between said first position and said second position, said pivotable engagement means constructed and arranged to be operatively associated with the side of the canister of the recessed lighting fixture;

means for retaining said bendable leg member in said second position;

whereby the recessed lighting fixture may be retained in the ceiling irrespective of ceiling thickness by first inserting the canister portion of the recessed lighting fixture into the ceiling with the bendable leg member in the first position and then pivoting said bendable leg member into its second position to engage the corner between the side of the hole and the top of the ceiling so that the engagement of said bendable leg member with the ceiling causes the bendable leg member to flex toward the recessed lighting fixture and engaging said means for retaining said bendable leg member in said second position.

7. The mounting system as defined in claim 6 wherein said means for retaining said bendable leg member in said second position is a resilient brace member.

8. The mounting system as defined in claim 7 wherein said resilient brace member includes an offset portion engagable with the side wall of the canister.

9. The mounting system as defined in claim 8 wherein said brace member includes a stop member engageable with the inside wall of the canister.

10. A recessed lighting system comprising:

a canister with a side wall constructed and arranged for recessed mounting in a ceiling;

a plurality of clips spaced around the periphery of said canister for mounting said canister to a ceiling, said clips having:

a bendable leg member, said bendable leg member having a first position along the side wall of the canister for permitting the insertion of said canister into a hole in said ceiling and a second position away from the side wall of the canister for retaining said canister in a ceiling;

a joint for pivoting said bendable leg member between said first position and said second position, said joint being located at the intersection of said canister side wall and said bendable leg member;

a resilient brace member for retaining said bendable leg member in said second position;

whereby the system may be inserted into a ceiling with said bendable leg member in said first position and then retaining said system in said ceiling by pivoting said bendable leg member to said second position so that said bendable leg member engages said ceiling so that the engagement of said bendable leg member with the ceiling causes the bendable leg member to flex toward the recessed lighting fixture and engaging said brace member with the side of said canister to retain said bendable leg member in said second position.

11. The system as defined in claim 10 wherein said resilient brace member includes an offset constructed and arranged to engage a hole formed in the side wall of said canister.

12. The system as defined in claim 10 wherein said brace member includes a stop member to prevent said arm member from moving beyond said second position.

13. The system as defined in claim 10 wherein said bendable leg member is constructed and arranged to be used with a wide variety of ceiling widths.

* * * * *